US008641467B2

(12) United States Patent
Quitmeyer et al.

(10) Patent No.: US 8,641,467 B2
(45) Date of Patent: Feb. 4, 2014

(54) SPARK IGNITION DEVICE AND GROUND ELECTRODE THEREFOR AND METHODS OF CONSTRUCTION THEREOF

(75) Inventors: Frederick J. Quitmeyer, Rochester Hills, MI (US); Kevin J. Kowalski, Perrysburg, OH (US); Mark S. McMurray, Toledo, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 0 days.

(21) Appl. No.: 13/620,786

(22) Filed: Sep. 15, 2012

(65) Prior Publication Data

US 2013/0012094 A1 Jan. 10, 2013

Related U.S. Application Data

(62) Division of application No. 12/780,166, filed on May 14, 2010, now Pat. No. 8,288,930.

(51) Int. Cl.
*H01J 9/00* (2006.01)

(52) U.S. Cl.
USPC ..... 445/7; 445/46; 445/49; 29/746

(58) Field of Classification Search
None
See application file for complete search history.

(56) References Cited

U.S. PATENT DOCUMENTS

| | | | | |
|---|---|---|---|---|
| 6,495,948 | B1 | 12/2002 | Garrett, III | |
| 6,707,237 | B2 | 3/2004 | Teramura et al. | |
| 6,853,116 | B2 | 2/2005 | Hori et al. | |
| 6,864,623 | B2 | 3/2005 | Ishikawa | |
| 7,259,506 | B1 | 8/2007 | Maxwell | |
| 7,291,961 | B2 | 11/2007 | Suzuki et al. | |
| 7,352,121 | B2 | 4/2008 | Ito et al. | |
| 7,521,850 | B2 | 4/2009 | Lykowski | |
| 7,671,521 | B2 | 3/2010 | Lykowski | |
| 8,026,654 | B2 * | 9/2011 | Kowalski et al. | 313/144 |
| 2002/0003389 | A1 | 1/2002 | Ishiguro | |
| 2009/0260242 | A1 * | 10/2009 | Ruether et al. | 33/366.21 |
| 2009/0284118 | A1 | 11/2009 | Tinwell | |
| 2009/0302733 | A1 | 12/2009 | Nunome et al. | |

* cited by examiner

*Primary Examiner* — Ashok Patel
(74) *Attorney, Agent, or Firm* — Robert L. Stearns; Dickinson Wright, PLLC

(57) ABSTRACT

A spark ignition device, ground electrode therefor, and methods of construction thereof are provided. The spark ignition device includes a generally annular ceramic insulator with a metal shell surrounding at least a portion of the ceramic insulator. A center electrode is received at least in part in the ceramic insulator and a ground electrode extends from the shell to a free end portion. A firing tip is attached adjacent the free end portion of the ground electrode to provide a spark gap between the center electrode and the firing tip. The free end portion is at least partially bounded by at least one "as laser cut" peripheral side extending adjacent the firing tip.

10 Claims, 2 Drawing Sheets

SPARK IGNITION DEVICE AND GROUND ELECTRODE THEREFOR AND METHODS OF CONSTRUCTION THEREOF

This divisional application claims priority to U.S. application Ser. No. 12/780,166, filed May 14, 2010 now U.S. Pat. No. 8,288,930, and is incorporated herein by reference.

BACKGROUND OF THE INVENTION

1. Technical Field

This invention relates generally to spark ignition devices, such as spark plugs for internal combustion engines, and more particularly to ground electrodes attached to a metal shell of the spark ignition device and to their method of construction.

2. Related Art

Modern automotive vehicles are required to meet increased power, low fuel consumption, and low exhaust emissions requirements, thus resulting in an increase in temperature of burning atmosphere in the engine. Therefore, spark ignition devices are subjected to increased temperatures, and in turn, have exhibited a reduced life in use. Accordingly, any improvements in promoting heat dissipation of the spark ignition device, particularly in the region of the ground electrode firing tip, is welcomed to prolong the potential useful life of the spark ignition device.

In addition, in accordance with known processes, the ground electrode is manufactured having an excess amount of ground electrode material surrounding a firing tip of the ground electrode. The presence of the excess ground electrode material about the firing tip decreases the ability of heat to dissipate from this region of ground electrode, thereby having a deleterious effect on the ground electrode and firing tip thereon. The excess material results largely due to the known mechanical trimming processes used to shape the region about the ground electrode firing tip, whether a straight or tapered configuration is mechanically cut adjacent the firing tip. Given mechanical cutting processes are typically employed, a predetermined amount of the ground electrode material must remain between an outer side periphery of the ground electrode and the firing tip to avoid damaging the attachment region of the ground electrode and/or the firing tip.

A spark ignition device constructed in accordance with this invention addresses these and other issues, as will be apparent to one having ordinary skill in the art.

SUMMARY OF THE INVENTION

According to one aspect of the invention, a spark ignition device is provided. The spark ignition device includes a generally annular ceramic insulator with a metal shell surrounding at least a portion of the ceramic insulator. Further, a center electrode is received at least in part in the ceramic insulator and a ground electrode extends from the shell to a free end portion. A firing tip is attached adjacent the free end portion of the ground electrode to provide a spark gap between the center electrode and the firing tip. In addition, the free end portion is at least partially bounded by at least one "as laser cut" peripheral side extending adjacent the firing tip.

In accordance with another aspect of the invention, a ground electrode for a spark ignition device is provided. The ground electrode has a ground electrode body extending from a proximal end configured for attachment to a metal shell to a free end portion. Further, a firing tip is attached adjacent the free end portion, wherein the free end portion is at least partially delimited by at least one "as laser cut" peripheral side extending immediately adjacent the firing tip.

In accordance with another aspect of the invention, a method of constructing a spark ignition device is provided. The method includes providing a generally annular ceramic insulator and disposing a center electrode at least in part in the ceramic insulator. Further, providing a metal shell and attaching a ground electrode to the metal shell with the ground electrode extending to a free end portion. Further, attaching a firing tip to the free end portion of the ground electrode and disposing the metal shell about at least a portion of the ceramic insulator. Further yet, laser cutting the free end portion of the ground electrode to provide at least one "as laser cut" peripheral side extending immediately adjacent the firing tip.

In accordance with another aspect of the invention, a method of constructing ground electrode for a spark ignition device is provided. The method includes providing a ground electrode body extending from a proximal end configured for attachment to a metal shell to a free end portion and attaching a firing tip adjacent the free end. Further; laser cutting the free end portion to form at least one "as laser cut" peripheral side extending adjacent the firing tip.

BRIEF DESCRIPTION OF THE DRAWINGS

These and other aspects, features and advantages of the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
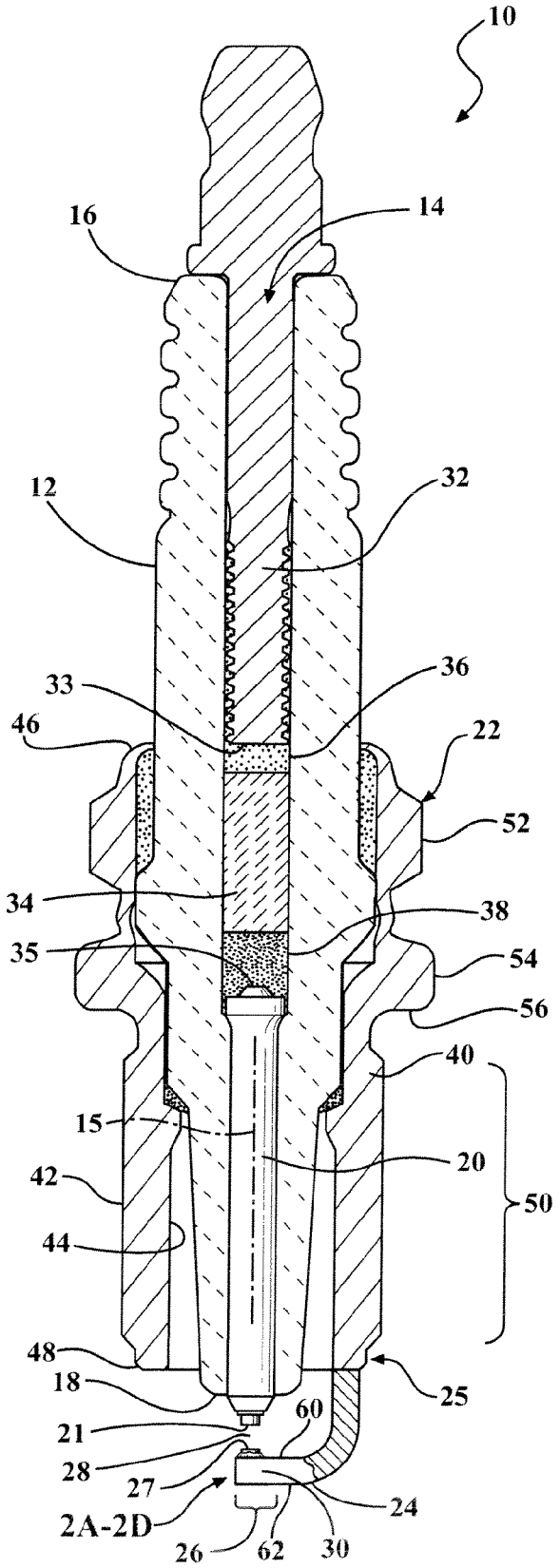
FIG. 1 is a cross-sectional elevation view of an ignition device with a ground electrode constructed in accordance with one aspect of the invention.

Referring in more detail to the drawings, FIG. 1 illustrates a spark ignition device 10 constructed in accordance with one presently preferred aspect of the invention for use in igniting a fuel/air mixture in internal combustion engines. The exemplary spark ignition device 10 is illustrated in the form of a spark plug that includes, among other things, an annular ceramic insulator 12 fabricated of aluminum oxide or another suitable electrically insulating material in known manner. The insulator 12 has a central passage 14 extending along a central longitudinal axis 15 between an upper proximal or terminal end 16 and a lower distal or nose end 18. A central electrode 20 is disposed at least in part in the central passage 14, with an end sparking surface, also referred to as firing surface 21, extending axially outwardly from the nose end 18. An electrically conductive metal shell 22 is disposed in sealed relation about at least a portion of the insulator 12, shown here as being sealed about lower and mid portions of the insulator 12. The shell 22 has at least one ground electrode 24 fixed thereto, such as via a weld joint 25, for example, wherein the ground electrode 24 extends to a free end portion 26. The ground electrode 24 has a sparking tip, also referred to as firing tip 27, attached thereto on the free end portion 26 to provide a spark gap 28 between the firing tip 21 of the center electrode 20 and the firing tip 27 of the ground electrode 24. The free end portion 26 is bounded at least in part by at least one "as laser cut" peripheral side 30 extending adjacent the firing tip 27, wherein the "as laser cut" peripheral side 30 results in minimal material of the ground electrode extending between the peripheral side 30 and the firing tip 27, thus, allowing heat to readily dissipate from the free end portion 26 of the ground electrode 24 in use. In addition, the "as laser cut" peripheral side 30 allows the free end portion 26 to be efficiently configured in manufacture, both before and/or after fixing the firing tip 27 to the ground electrode 24. Accordingly, aside from providing the ground electrode 24, and thus, spark ignition device 10 with an extended useful life, the manufacturing process is made efficient, thereby reducing the costs associated with achieving the improved configuration of the free end portion 26.

The spark ignition device 10 has an electrically conductive terminal stud 32 disposed in the central passage 14 of the insulator 12 with a free lower end 33 of the terminal stud 32 being disposed adjacent a resistor layer 34 which is arranged between the lower end 33 and an upper end 35 of the central electrode 20. Conductive glass seals 36, 38 separate the resistor layer 34 from the stud 32 and central electrode 20, respectively, in known fashion.

The electrically conductive metal shell 22 may be made from any suitable metal, including various coated and uncoated steel alloys, such as various steel alloys, and may be coated with a Zn or Ni-base alloy coating or the like in known manner. The shell 22 has a generally annular, tubular shell body 40 with a generally annular outer surface 42 and inner surface 44 extending coaxially along the longitudinal central axis 15 between an upper terminal end 46, also referred to as proximal end, and a lower fastening end 48, also referred to as distal end. The fastening end 48 typically has an external threaded region 50 configured for threaded attachment within a combustion chamber opening of an engine block (not shown). The shell 22 may be provided with an external hexagonal tool receiving member 52 or other feature to facilitate removal and installation of the spark plug 10 in the combustion chamber opening. The feature size will preferably conform with an industry standard tool size of this type for the related application. Of course, some applications may call for a tool receiving interface other than a hexagonal feature, such as slots to receive a spanner wrench, or other features such as are known in racing spark plug and other applications. The shell 22 also has an annular flange 54 extending radially outwardly from the outer surface 42 to provide an annular, generally planar sealing seat 56 from which the threaded region 50 depends. The sealing seat 56 may be paired with a gasket (not shown) to facilitate forming a hot gas seal of the space between the shell 22 and the threaded bore in the combustion chamber opening. Alternately, the sealing seat 56 may be configured as a tapered seat to provide a close tolerance and a self-sealing installation against a sealing surface of the cylinder head which is also designed with a mating taper for this style of spark plug seat.

As discussed above, the free end portion 26 of the ground electrode 24 is configured to maximize the useful life of the spark plug 10, while in addition, is constructed using an efficient laser cutting process in manufacture to achieve the desired configuration. The laser cutting process allows the free end portion 26 to be configured having a variety of desired configurations, including shapes generally unattainable using mechanical cutting processes, at least without incurring extreme expense, with some of the laser cut shapes being shown in FIGS. 2A-2D, by way of example and without limitation.

Figure 2A:
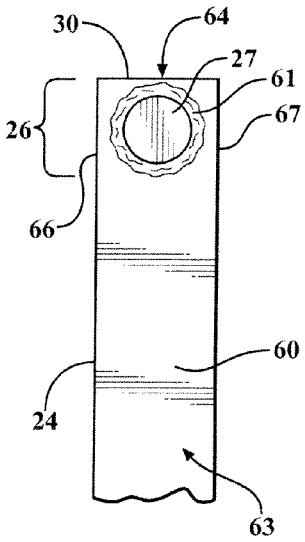
FIG. 2A is an enlarged partial plan view of one embodiment of the ground electrode showing an "as laser cut" free end of the ground electrode.

In FIG. 2A, a portion of the ground electrode 24 constructed in accordance with one aspect of the invention is shown. As shown, the ground electrode 24 has the firing tip 27 attached to an upper surface 60 of the free end portion 26, such as via an annular weld pool 61 extending about an outer circumference of the firing tip 27. The free end portion 26 includes the "as laser cut" peripheral side 30 extending adjacent the firing tip 27, wherein the "as laser cut" peripheral side 30 extends from the upper surface 60 to a lower surface 62 (FIG. 1) of the ground electrode body 63. In this embodiment, the peripheral side 30 forms a terminal end 64 of the free end portion 26, and is shown as being a flat, planar or substantially planar surface that extends tangentially or substantially tangentially with the weld pool 61. The free end portion 26 also includes non-laser cut, generally parallel side surfaces 66, 67 that extend generally transverse to the terminal end 64 along the full length of the body 63, wherein the non-laser cut side surfaces 66, 67 terminate at the "as laser cut" terminal end 64 at substantially square corners. The terminal end 64, being laser cut, is formed immediately adjacent the weld pool 61, such that minimal, if any, material of the ground electrode body 63 is present between the weld pool and the terminal end 64. Accordingly, a direct heat flow path is provided to allow heat to readily dissipate from the ground electrode 24 during use.

Figure 2B:
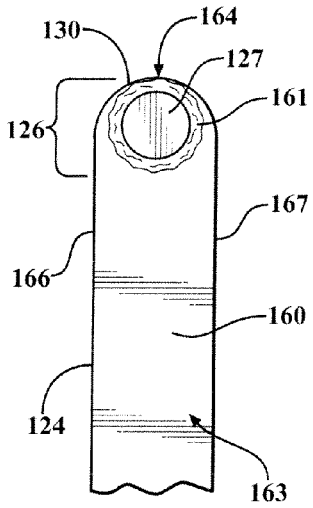
FIG. 2B is an enlarged partial plan view of another embodiment of the ground electrode showing another "as laser cut" free end of the ground electrode.

In FIG. 2B, a portion of a ground electrode 124 constructed in accordance with another aspect of the invention is shown, wherein the same reference numerals, offset by a factor of 100, are used to identify similar features discussed above. As shown, the ground electrode 124 has the firing tip 127 attached to an upper surface 160 of the free end portion 126, such as via an annular weld pool 161 extending about an outer circumference of the firing tip 127. The free end portion 126 includes an "as laser cut" peripheral side 130 extending adjacent the firing tip 127, wherein the "as laser cut" peripheral side 130 forms a terminal end 164 of the free end portion 126 and further extends about a semicircular or substantially semicircular portion of the weld pool 161 into tangential or substantially tangential relation with generally parallel sides 166, 167 of the ground electrode body 163. Accordingly, unlike the previous embodiment having a flat, planar or substantially planar "as laser cut" side, the "as laser cut" side 130 here is semicircular or substantially semicircular. Accordingly, the "as laser cut" side 130 extends about a generally semicircular portion of the weld pool 161, such that minimal, if any, material of the ground electrode body 163 is present between the weld pool 161 and the "as laser cut" side 130 in this region. As such, the direct heat flow path is increased over the previous embodiment to include the arcuate region over which the "as laser cut" side 130 extends.

Figure 2C:
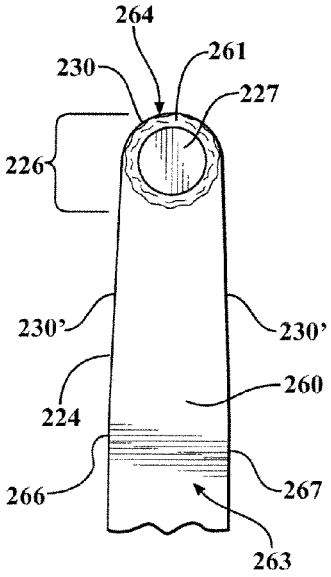
FIG. 2C is an enlarged partial plan view of another embodiment of the ground electrode showing another "as laser cut" free end of the ground electrode.

In FIG. 2C, a portion of a ground electrode 224 constructed in accordance with another aspect of the invention is shown, wherein the same reference numerals, offset by a factor of 200, are used to identify similar features discussed above. As shown, the ground electrode 224 has the firing tip 227 attached to an upper surface 260 of the free end portion 226, such as via an annular weld pool 261 extending about an outer circumference of the firing tip 227. The free end portion 226 includes an "as laser cut" peripheral side 230 extending adjacent the firing tip 227, wherein the "as laser cut" peripheral side 230 forms a terminal end 264 of the free end portion 226 and further extends about a semicircular or substantially semicircular portion of the weld pool 261. However, unlike the embodiment of FIG. 2B, the "as laser cut" peripheral side 230 does not extend into tangential or substantially tangential relation with the generally parallel sides 266, 267 of the ground electrode body 263. Rather, the peripheral side 230 includes a pair of flat "as laser cut" sides 230' extending away from a substantially semicircular "as laser cut" side 230 in diverging relation from the terminal end 264. The distance over which the sides 230' extend is determined by the angle with which they merge with the parallel sides 266, 267, which can be altered as desired. Accordingly, the semicircular region over which the "as laser cut" sides 230, 230' extend further reduce the amount of material of the ground electrode body 263. Accordingly, the direct heat flow path is increased even further over the previous embodiments to allow an increased degree of heat dissipation from the ground electrode 224 the arcuate region over which the "as laser cut" side 230, 230' extends.

Figure 2D:
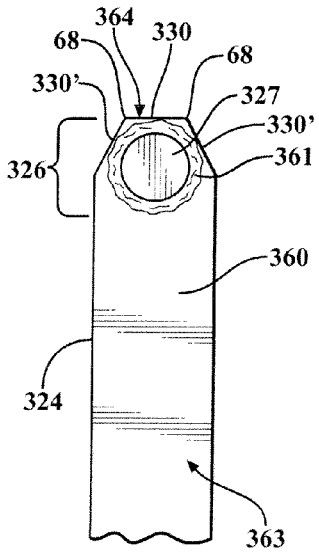
FIG. 2D is an enlarged partial plan view of yet another embodiment of the ground electrode showing an "as laser cut" free end of the ground electrode.

In FIG. 2D, a portion of a ground electrode 324 constructed in accordance with yet another aspect of the invention is shown, wherein the same reference numerals, offset by a factor of 300, are used to identify similar features discussed above. As shown, the ground electrode 324 has the firing tip 327 attached to an upper surface 360 of the free end portion 326, such as via an annular weld pool 361 extending about an outer circumference of the firing tip 327. The free end portion 326 includes the "as laser cut" peripheral side 330 as described for FIG. 2A, wherein the peripheral side 330 forms a flat terminal end 364 of the free end portion 326, and further includes a pair of substantially flat "as laser cut" peripheral sides 330' converging to the substantially flat "as laser cut" peripheral side 330 to provide the free end portion 326 with a frustroconical shape. Each of the sides 330, 330' extends tangentially or in substantially tangential, flush relation with the weld pool 361, and thus, an increased heat flow path is provided over that of FIG. 2A to allow heat to readily dissipate from the ground electrode 324 during use. Given the sides 330, 330' are flat or substantially flat, a pair of small corner regions 68 of material forming the ground electrode body 363 remain present at the terminal end 364 of the electrode 324.

Obviously, many modifications and variations of the present invention are possible in light of the above teachings. It is, therefore, to be understood that within the scope of the appended claims, the invention may be practiced otherwise than as specifically described. Accordingly, the invention is ultimately defined by the scope of any allowed claims, and not solely by the exemplary embodiments discussed above.

What is claimed is:

1. A method of constructing a spark ignition device, comprising:

providing a generally annular ceramic insulator;

disposing a center electrode at least in part in the ceramic insulator;

providing a metal shell;

attaching a ground electrode to the metal shell with the ground electrode extending to a free end portion;

attaching a firing tip to the free end portion;

disposing the metal shell about at least a portion of the ceramic insulator; and laser cutting the free end portion of the ground electrode to provide at least one "as laser cut" peripheral side extending immediately adjacent the firing tip.

2. The method of claim 1 further including laser cutting the at least one "as laser cut" peripheral side having a substantially semicircular portion.

3. The method of claim 2 further including laser cutting the substantially semicircular portion immediately adjacent a weld pool attaching the firing tip to the ground electrode.

4. The method of claim 2 further including laser cutting the "as laser cut" peripheral side having a pair of planar "as laser cut" sides diverging away from said substantially semicircular "as laser cut" side.

5. The method of claim 1 further including laser cutting the at least one "as laser cut" peripheral side having a pair of substantially flat "as laser cut" peripheral sides converging to another substantially flat "as laser cut" peripheral side to provide the free end portion with a frustroconical shape.

6. A method of constructing ground electrode for a spark ignition device, comprising:

providing a ground electrode body extending from a proximal end configured for attachment to a metal shell to a free end portion;

attaching a firing tip adjacent to the free end portion; and laser cutting the free end portion to form at least one "as laser cut" peripheral side extending immediately adjacent the firing tip.

7. The method of claim 6 further including laser cutting the at least one "as laser cut" peripheral side having an actuate portion.

8. The method of claim 7 further including laser cutting the "as laser cut" peripheral side immediately adjacent a weld pool after attaching the firing tip to the ground electrode.

9. The method of claim 7 further including laser cutting the "as laser cut" peripheral side having a pair of flat "as laser cut" sides diverging away from the arcuate portion.

10. The method of claim 6 further including laser cutting the at least one "as laser cut" peripheral side having a pair of substantially flat "as laser cut" peripheral sides converging to another substantially flat "as laser cut" peripheral side to provide the free end portion with a frustroconical shape.

* * * * *